United States Patent [19]

DeGelder

[11] Patent Number: 5,033,624

[45] Date of Patent: Jul. 23, 1991

[54] HANGING FILE FRAME UNIT

[75] Inventor: Jacob DeGelder, San Pedro, Calif.

[73] Assignee: Acco World Corporation, Wheeling, Ill.

[21] Appl. No.: 416,640

[22] Filed: Oct. 3, 1989

[51] Int. Cl.[5] ..... A47F 5/00

[52] U.S. Cl. ..... 211/10; 211/46; 211/162

[58] Field of Search ..... 211/10, 11, 46, 162, 211/44.5; 108/28, 29

[56] References Cited

U.S. PATENT DOCUMENTS

| | | | |
|---|---|---|---|
| 2,595,837 | 5/1952 | Freeman | 211/10 |
| 4,527,694 | 7/1985 | Bolt et al. | 211/46 |
| 4,714,166 | 12/1987 | Hann et al. | 211/162 X |

*Primary Examiner*—Robert W. Gibson, Jr.
*Attorney, Agent, or Firm*—Pennie & Edmonds

[57] ABSTRACT

A file frame unit for spanning support between two desks or similar supports for carrying a group of hanging files. The frame unit having end pieces shaped to rest on the supports and capable of being releasably clamped to the supports. The file frame may be curved for location on and supported by supports positioned at angles to one another.

5 Claims, 3 Drawing Sheets

HANGING FILE FRAME UNIT

BACKGROUND OF THE INVENTION

File frames configured in arcs or circles are old (U.S. Pat. Nos. 2,595,837, 2,711,741, and 2,920,765). File units attachable to desks are also old (U.S. Pat. No. 3,642,338).

None of the file frames or units previously proposed are configured for ready support by two items of furniture or other similar supports.

SUMMARY OF THE INVENTION

Broadly, the present invention is a file frame configured for ready support on two spaced-apart desks or other supports. The frame, which is preferably curved, has end pieces for attachment to the desks and spaced-apart side rails between the end pieces upon which file folders may be hung. The end pieces accommodate clamping fasteners to fasten the end pieces to the desks.

It is a feature that the frame may include a crosspiece shaped to function as a tray.

DETAILED DESCRIPTION OF THE INVENTION

Figure 1:
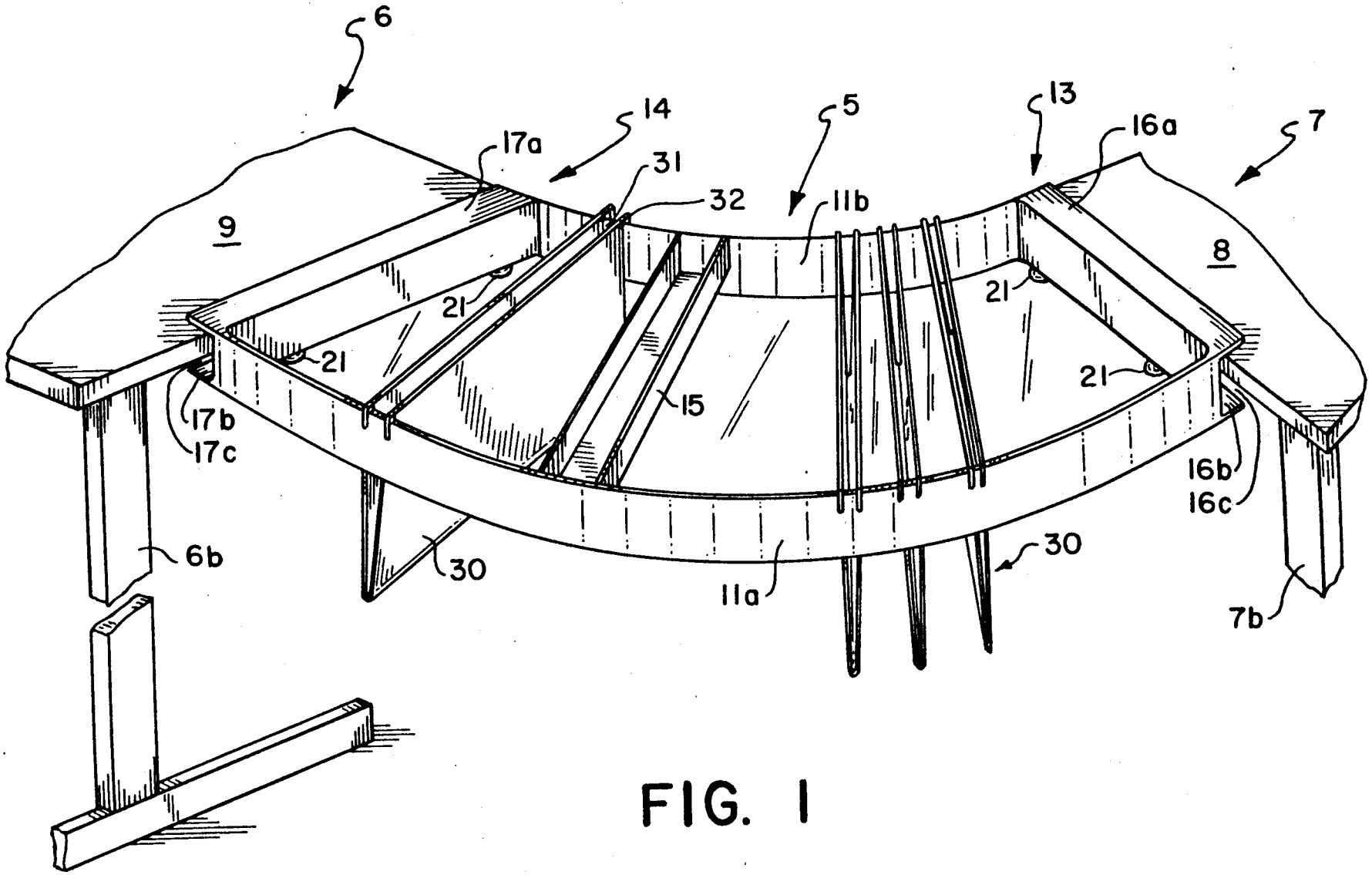
FIG. 1 is a perspective view of the invention positioned between two desks.

Referring to the figures, curved frame unit 5 positioned between desks 6 and 7 includes perimeter frame 11 having integrally formed outer vertical web frame rails 11*a*, 11*b* and integrally formed U-shaped end pieces 13, 14. Each end piece 13, 14 in turn has upper extensions 17*a*, 16*a* and preferably substantially equally-spaced through their length. The depth of web rails 11*a*, 11*b* determines the spacing of upper and lower extensions 16*a*, 16*b* and 17*a*, 17*b* which spacing is selected to be sufficient to accommodate the thicknesses of desk tops 8, 9 together with clamp means to be described. Extension pairs 16*a*, 16*b*, and 17*a*, 27*b* create chambers 16*c*, 17*c* therebetween.

Figure 3:
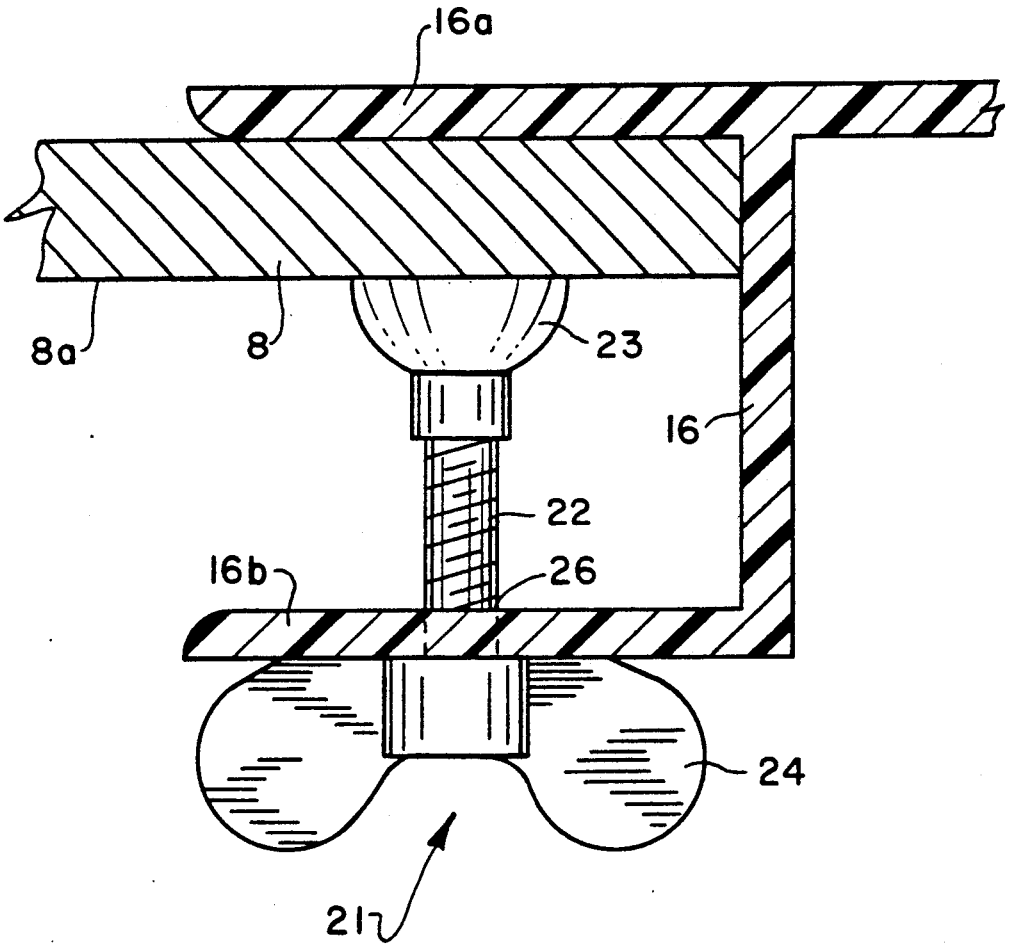
FIG. 3 is an enlarged partial sectional view showing a clamp fastener in an end piece.

To secure unit 5 to desk tops 8, 9, hand operated screw clamps 21 are located in chambers 16*c*, 17*c* which clamps 21 include threaded stem 22, stem clamp head 23 and wing hand piece 24 for turning. With respect to FIG. 3, threaded hole 26 in lower extensions 16*b*, accommodates stem 22 which moves upwardly as rotated clockwise (as viewed from below in FIG. 3) until clamp head 23 engages and is urged against the under surface 8*a* of desk top 8.

Hanging folders 30 with document pockets 31 and end hooks 32 are hung on and slidable along the top surfaces of the rails 11*a*, 11*b*. Also shown in FIG. 1 are legs 6*b* and 7*b* of desks 6 and 7 and crosspiece tray 15.

Figure 2C:
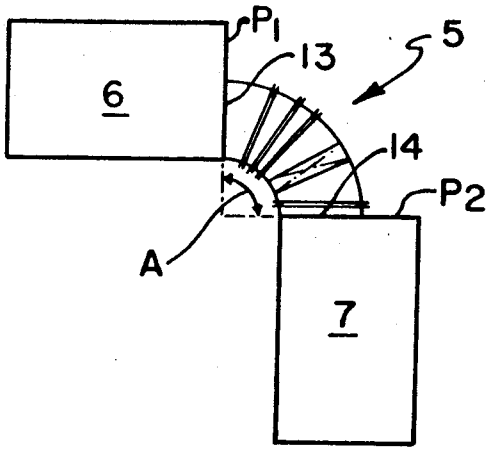
FIG. 2*a–e* shows a plurality of embodiments of the invention.
Figure 2E:
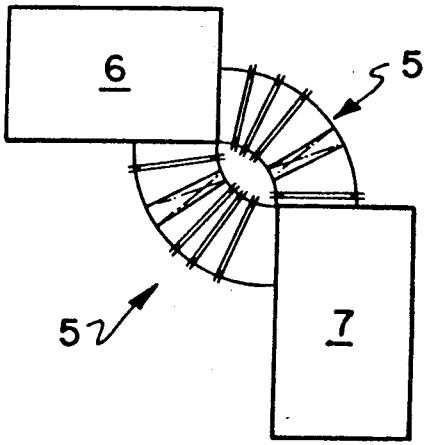
Figure 2B:
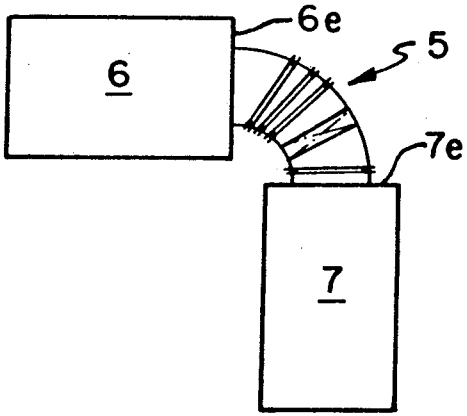

Turning to FIG. 2*a–e*, units 5 with left and right curvature are shown in a variety of positions between desks or similar support objects. Unit 5, as shown in FIGS. 2*a–e*, have end pieces 13, 14 which lie in planes $P_1$, $P_2$ at ninety (90°) degrees to one another (see angle A of FIG. 2*c*). Depending on the spacing of desks 6 and 7, unit 5 may be positioned at various locations on desk ends 6*e*, 7*e* which desk ends are longer than unit end pieces 13, 14 (FIG. 2*b*). Thus, as the spacing of the desks 6, 7 vary the support locations along sides (s) and edges (e) also vary.

Figure 2D:
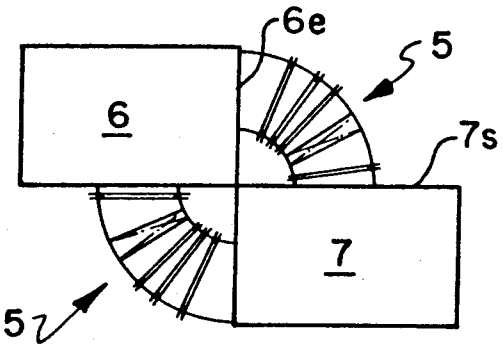
Figure 2A:
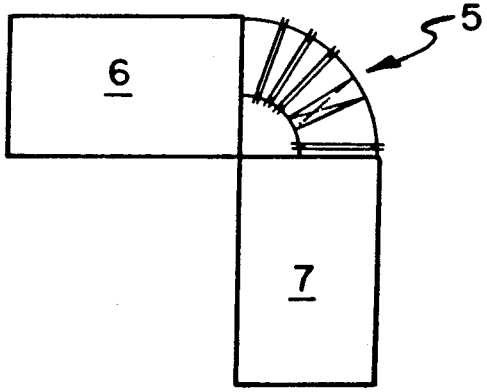

Unit 5 may also be positioned between the side 7*s* and desk 6 and the end 7*e* of desk 6 (FIG. 2*d*) and two units 5 can be transversely connected to two desks 6 and 7 at the same time (FIGS. 2*d*, 2*e*).

I claim:

1. A file frame unit capable of being supported between spaced-apart supports comprising a. a first rail of defined length having two ends with an end piece at each end, and a second rail also having two ends said first and second rails being substantially equally spaced apart, said end pieces connected to the two ends of said second rail and said end pieces on each rail end including a horizontal extension, said horizontal extensions lying in a horizontal plane and at a substantial angle to one another;

b. releasably engaging clamping means engaging said end pieces to said spaced-apart supports.

2. The file frame unit of claim 1 in which the rails are curved and their end pieces are integrally formed with the rails.

3. The file frame unit of claim 1 in which the end pieces are positioned to about ninety degrees to one another.

4. The file frame unit of claim 1 in which the end pieces are U-shaped creating a chamber for accommodating said clamping means includes a clamping head which urges a support and an end piece against one another.

5. The file frame unit of claim 1 in which one of the supports is a desk top, the end piece is shaped to create a chamber for receiving the desk top and the clamping means lies and is operable within the end piece chamber.

* * * * *

UNITED STATES PATENT AND TRADEMARK OFFICE

CERTIFICATE OF CORRECTION

PATENT NO. : 5,033,624

DATED : July 23, 1991

INVENTOR(S) : Jacob DeGelder

It is certified that error appears in the above-identified patent and that said Letters Patent is hereby corrected as shown below:

Column 1, lines 38-39, "upper extensions 17a, 16a and preferably" should read --upper extensions 17a,16a and lower extensions 17b, 16b. Rails 11a, 11b are curved and preferably--.

Column 1, line 46, "17a,27b" should read --17a, 17b--.

Column 2, line 7, "FIG. 2a-e" should read --FIGS. 2a-e--.

Signed and Sealed this

Fifth Day of January, 1993

*Attest:*

DOUGLAS B. COMER

*Attesting Officer*

*Acting Commissioner of Patents and Trademarks*